United States Patent [19]

Martin et al.

[11] Patent Number: 4,938,184

[45] Date of Patent: Jul. 3, 1990

[54] ENGINE OIL RETURN SYSTEM

[75] Inventors: Harold M. Martin, Southfield; Peter R. Crawford, Northville, both of Mich.

[73] Assignee: General Motors Corporation, Detroit, Mich.

[21] Appl. No.: 410,436

[22] Filed: Sep. 21, 1989

[51] Int. Cl.[5] ..... F16N 31/00

[52] U.S. Cl. ..... 123/195 C; 184/106

[58] Field of Search ..... 123/198 E, 195 C, 196 R; 184/106, 6.5

[56] References Cited

U.S. PATENT DOCUMENTS

| | | | |
|---|---|---|---|
| 1,589,883 | 6/1926 | Herrmann | 184/106 |
| 3,100,028 | 8/1963 | Booth et al. | 184/106 |
| 3,653,464 | 4/1972 | Jacobsen et al. | 184/106 |
| 4,134,380 | 1/1979 | Niwa et al. | 123/196 R |
| 4,270,497 | 6/1981 | Valerio | 184/106 |
| 4,519,348 | 5/1985 | Hamilton | 123/196 R |
| 4,674,457 | 6/1987 | Berger et al. | 123/196 R |
| 4,683,850 | 8/1987 | Bauder | 123/196 R |

FOREIGN PATENT DOCUMENTS

| | | | |
|---|---|---|---|
| 0088416 | 5/1983 | Japan | 184/6.5 |
| 0113521 | 7/1983 | Japan | 184/106 |

*Primary Examiner*—David A. Okonsky

*Attorney, Agent, or Firm*—Robert J. Outland

[57] ABSTRACT

In a transversely mounted engine, oil intake efficiency is improved by a sloped baffle which funnels the returning engine oil to the oil intake in the oil pan, a small clearance between the baffle and the pan to retard oil surge beyond the baffle, a dam adjacent the oil intake port to inhibit the formation of a vortex that draws air into the port, and optimum placement of the intake in the pan.

3 Claims, 1 Drawing Sheet

ENGINE OIL RETURN SYSTEM

FIELD OF THE INVENTION

This invention relates to an oil return system for a transversely mounted internal combustion engine.

BACKGROUND OF THE INVENTION

Traditionally, automotive internal engine design has evolved for application to vehicles with rear wheel drive and longitudinally mounted engines. The advent of front wheel drive vehicles led to the use of the traditional engine designs with minimal modifications for transverse mounting. For the oil return system, the oil pump for the longitudinally mounted engine has an oil intake near the rear of the oil pan. During vehicle forward acceleration the pool of oil in the pan surges to the rear of the pan so that the intake will be well supplied with oil. During braking the deceleration moves the oil toward the front of the pan but not enough to uncover the intake. Likewise, accelerations due to turning cause lateral oil movement but not enough to present a problem.

Some front wheel drive vehicles with transversely mounted engines have the same oil pickup system as described above with the intake favoring the "rear" or left end of the pan. As shown in FIG. 1, the oil pan 10 contains an oil pump 12 which is attached to the engine, not shown, by a support 14, an oil intake 16 attached to the pump, and a windage baffle 18. A pool of oil 20 in the pan assumes a position determined by gravity and other forces. Such vehicles may experience a reduction of oil intake efficiency during aggressive left turns. This occurs because during the left turn the oil rushes to the front of the oil pan (toward the right side of the vehicle), as shown in FIG. 1, and no longer leaves the oil intake fully submerged in oil; then some air is entrained in the oil which is drawn into the oil pump. The actual reduction in efficiency is a function of the G force on the oil. High performance vehicles can develop high turning acceleration on the order of 0.85 G's and this could result in the surface of the oil tilting at a 40° angle. Of course less severe turning acceleration results in a smaller angle.

A factor in the oil flow management in an oil pan is the windage baffle 18 which is a generally horizontal sheet of metal spaced from the side walls of the pan and interposed between the rapidly moving engine parts and the pool of oil 20 to prevent air currents from whipping up the oil and causing aeration. Some of the oil returning to the pan from the engine runs down the sides of the crankcase past the baffle and some drips onto the baffle and runs over the edge to the bottom of the pan. When oil surges onto the top surface of the baffle 18 during a turn, the horizontal baffle impedes the return of the oil to the vicinity of the intake.

SUMMARY OF THE INVENTION

It is therefore an object of the invention to enhance the oil intake efficiency for a transversely mounted engine.

It is another object of the invention to improve the oil intake placement in conjunction with a baffle design for preferentially guiding oil to the intake.

The invention is carried out by means for enhancing the flow of oil to the intake comprising: an oil pan having walls and a bottom, an oil pump in the pan, the pump including an oil intake at the bottom of the pan and positioned for immersion in a pool of oil during lateral acceleration in either direction, and a baffle in the oil pan above the normal operating oil level, the baffle having three sides spaced from three of the pan walls and conforming to the shape of the pan walls, and further having an aperture above the oil intake and surfaces sloped inwardly and downwardly from the three sides to the aperture for expediting oil flow from the engine to the intake.

The invention also comprehends a dam on the intake device to prevent the formation of a vortex that draws air into the intake port.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE INVENTION

The ensuing description and corresponding drawings are directed to a specific system for enhancing the oil return to an oil pump in a particular transversely mounted engine. In principal, the teaching herein applies to other engines. The optimum shape and location of parts of the system is dependent on the particular engine and especially the shape of the particular oil pan. For a given engine, empirical determination of the preferred placement of the intake is readily accomplished. The rear of the engine is mounted toward the left of the vehicle so that as used herein, the rear of the pan refers t the portion nearest the left side of the vehicle and the front of the pan is the portion nearest the right side of the vehicle.

Figure 1:
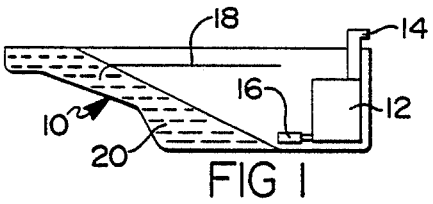
FIG 1 PRIOR ART
FIG. 1 is a schematic view of a prior art oil pan, baffle and oil intake arrangement.
Figure 2:
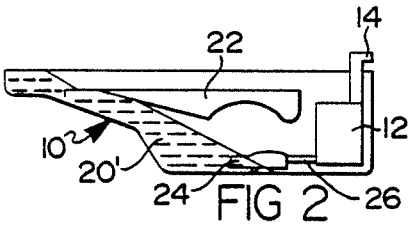
FIG. 2 is a schematic view of an improved oil pan, baffle and oil intake arrangement according to the invention.

In contrast to the prior system of FIG. 1, the improved oil management system is shown in FIG. 2. The oil pan 10, the pump 12 and its support 14 remain the same. A sloped funnel-like baffle 22 for guiding the oil flow to the site of the oil intake replaces the previous windage baffle 18 yet retains the windage protection function. An improved oil intake 24 is positioned further forward than the prior intake 16 to assure that starvation does not occur for either right or left turns. The intake is coupled to the oil pump 12 by a tube 26 which is sized according to the preferred position of the intake 24.

Figure 3:
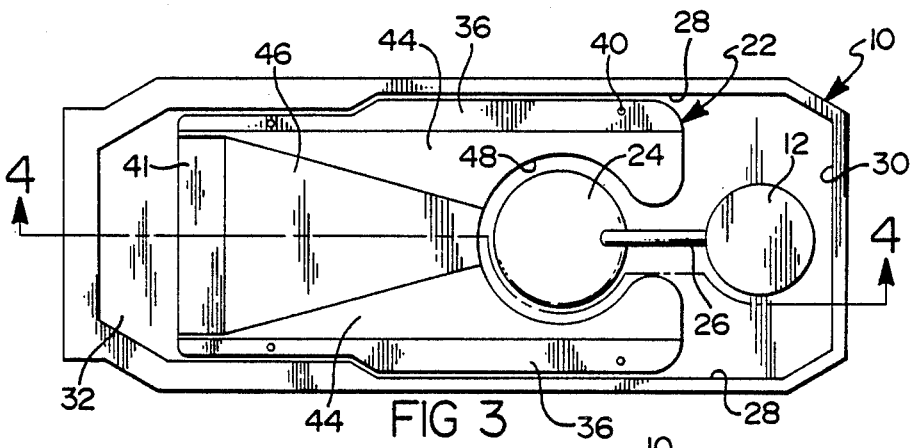
FIG. 3 is a top view of an oil pan, baffle and intake arrangement according to the invention.
Figure 4:
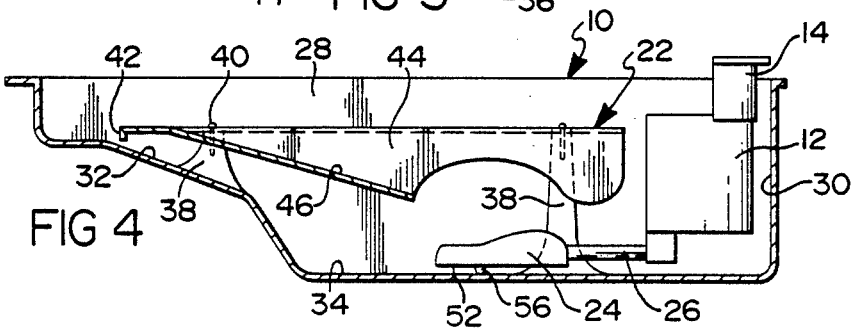
FIG. 4 is a cross section taken along line 4—4 of FIG. 3.
Figure 5:
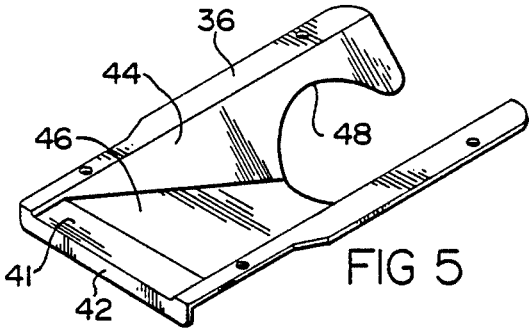
FIG. 5 is an orthometric view of the baffle according to the invention.

The pan 10 and baffle 22 are best shown in FIGS. 3 and 4 while the baffle is further shown in FIG. 5. The pan 10 is elongated in the transverse vehicle direction and has generally vertical side walls 28, a generally vertical rear wall 30, a sloping front wall 32 and a bottom surface 34. Details of the rim and maintaining means are conventional and are omitted for clarity. The pump 12 is mounted in the rear of the pan 10 and the baffle 22 extends from the front wall to a point in front of the pump 12.

The baffle 22 has outer marginal side edges 36 which are flat with depending flanges and are mounted horizontally in the same position as the prior (FIG. 1) baffle and are secured to posts 38 formed in the pan by fasteners 40. The edges 36 are spaced from the walls 28, 32 of the pan by one half inch or less to allow oil dripping down the walls to enter the sump while retarding a surge of oil to the front of the pan. A front shelf 41 extending between the side edges 36 has a front flange 42 closely spaced (within one half inch) from the front wall 32 of the pan to control the oil flow. Between the side edges 36, the baffle 22 has side panels 44 sloping inwardly and downwardly at a 45° angle to meet a front panel 46 which slopes down at about 14° or 15°. Each of the panels 44, 46 terminates at an inner aperture 48 which (as seen in plan view) defines a generally keyhole-shaped aperture with a round portion concentric with the intake 24. That is, the aperture is disposed above the intake 24 so that oil dripping or flowing from the sloped panels will fall around the perimeter of the intake 24. The aperture 48 extends to the rear edge of the baffle to allow the intake 24 and tube 26 to pass the baffle when the oil pan is being assembled to the engine.

Figure 6:
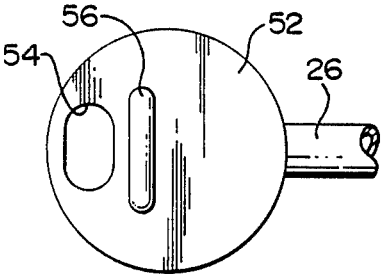
FIG. 6 is a bottom view of the oil intake according to the invention.

The intake 24, as best seen in FIGS. 4 and 6, is a hollow disk-shaped sheet metal canister having a contoured upper surface 50 for accommodating attachment to the pipe 26 and a generally flat bottom surface 52 having an elongated port 54 near the front edge of the intake and an elongated downward projection or dam 56 parallel to and to the rear of the port 54. The port 54 may be, for example, one inch long and the dam 56 one and one half inches long and spaced one half inch from the edge of the port. The dam 56 also serves as spacer and is sized to maintain the intake 24 about 4 or 5 mm from the bottom of the pan. The oil pump 12 is mounted to the engine such that when assembled the dam 56 touches or nearly touches the bottom of the pan.

In operation, it has been found that in the absence of the dam 56 on the bottom of the intake 24 the oil flowing into the port 54 forms a vortex which draws in air when the oil pool is shallow, as shown in FIG. 2 for the aggressive left turn condition. The dam 56 frustrates the formation of the vortex and thus prevents loss of oil pressure for the shallow pool condition. Further, during a left turn, the oil surges to the front of the pan but due to the small gap between the baffle 22 and the walls 28, 32, the flow into the pool 20' above the baffle is restricted and the oil leaves the region of the intake 24 less rapidly. The return of any oil from the pool 20' above the baffle and from the engine is enhanced by the sloped baffle 22 which facilitates flow to the intake.

It will thus be seen that each of the features of the invention, i.e. the sloped baffle, the small baffle-to-wall spacing, the position of the intake within the pan, and the dam on the intake contribute to better oil management. In concert, these features assure no diminution in oil intake efficiency even when the vehicle develops 0.85 G's in a left or right turn which results in a 40° slope of the oil pool surface.

The embodiments of the invention in which an exclusive property or privilege is claimed are defined as follows:

1. In an automotive vehicle having a transversely mounted internal combustion engine having an oil intake, means for enhancing the flow of oil to the intake comprising:

an oil pan having walls and a bottom, an oil pump in the pan, the pump including an oil intake at the bottom of the pan and positioned for immersion in a pool of oil during lateral acceleration in either direction, a baffle in the oil pan above the normal operating oil level, the baffle having three sides spaced from three of the pan walls and conforming to the shape of the pan walls, and further having an aperture above the oil intake and surfaces sloped inwardly and downwardly from the three sides to the aperture for expediting oil flow from the engine to the intake.

2. The invention as defined in claim 1 wherein oil in the pan is subject to surging toward one portion of the pan and away from the intake during lateral acceleration in one direction, and the sides of the baffle being sufficiently close to the pan side walls in the said one portion to impede the flow of oil beyond the baffle during the lateral acceleration, thereby retarding the flow from the intake.

3. The invention as defined in claim 1 wherein during lateral acceleration in one direction oil in the pan is subject to surging toward one portion of the pan and away from the intake, so that the oil level at the intake is shallow and there is a tendency for a vortex to form and draw air into the intake, the intake including a lower surface spaced from the bottom of the oil pan, a port in the lower surface for drawing in oil, and a dam in the lower surface at one side of the port and extending toward the bottom of the pan for inhibiting the formation of a vortex.

* * * * *